US009212472B2

(12) United States Patent
Gilmore

(10) Patent No.: US 9,212,472 B2
(45) Date of Patent: Dec. 15, 2015

(54) ANGLED SPRAY HEAD HOLDER

(75) Inventor: Edward John Gilmore, County Down (GB)

(73) Assignee: Munster Simms Engineering Limited, County Down (GB)

( * ) Notice: Subject to any disclaimer, the term of this patent is extended or adjusted under 35 U.S.C. 154(b) by 1027 days.

(21) Appl. No.: 12/664,609

(22) PCT Filed: Jun. 16, 2008

(86) PCT No.: PCT/EP2008/004810
§ 371 (c)(1),
(2), (4) Date: Jul. 20, 2010

(87) PCT Pub. No.: WO2008/151836
PCT Pub. Date: Dec. 18, 2008

(65) Prior Publication Data

US 2010/0288852 A1 Nov. 18, 2010

(30) Foreign Application Priority Data

Jun. 14, 2007 (GB) ..... 0711496.0
Oct. 3, 2007 (GB) ..... 0719338.6

(51) Int. Cl.
*A01G 25/06* (2006.01)
*E03C 1/02* (2006.01)
*E03C 1/04* (2006.01)

(52) U.S. Cl.
CPC ..... *E03C 1/021* (2013.01); *E03C 1/025* (2013.01); *E03C 1/0408* (2013.01)

(58) Field of Classification Search
CPC ..... E03C 1/021; E03C 1/025; E03C 1/06; E03C 1/066
USPC ..... 239/200, 201, 202, 203, 204, 205; 248/58, 65, 342, 343, 75; D26/60; 292/210; 362/432
See application file for complete search history.

(56) References Cited

U.S. PATENT DOCUMENTS 239,824 A * 4/1881 Morris ..... 292/238
1,754,855 A * 4/1930 Graff ..... 362/432
2,776,168 A * 1/1957 Schweda ..... 239/587.4

(Continued)

FOREIGN PATENT DOCUMENTS

EP 0080591 A1 6/1983
EP 0733747 A2 9/1996
FR 2398247 A1 2/1979

(Continued)

OTHER PUBLICATIONS

PCT/EP2008/004810, International Search Report, 2 pages.

(Continued)

*Primary Examiner* — Arthur O Hall
*Assistant Examiner* — Viet Lee
(74) *Attorney, Agent, or Firm* — Lathrop & Gage LLP

(57) ABSTRACT

A spray head holder (250) comprising an outer rim and a socket (252) for receiving a spray head. The socket defines an inner mouth (254) surrounded by the outer rim, the inner mouth (254) and outer rim being disposed in respective planes that are obliquely disposed with respect to one another. The longitudinal axis of the socket is obliquely disposed with respect to the plane in which said outer rim lies. A bevelled lip is provided around the outer rim. The spray head holder (250) is particularly suited for fitting to walls behind which space is restricted, for example the bulkhead of a boat.

17 Claims, 7 Drawing Sheets

(56) References Cited

U.S. PATENT DOCUMENTS

| | | | | | |
|---|---|---|---|---|---|
| 3,110,038 | A | * | 11/1963 | Dornbierer | 4/570 |
| 3,485,449 | A | * | 12/1969 | Wilson | 239/201 |
| 4,781,327 | A | * | 11/1988 | Lawson et al. | 239/203 |
| 5,253,952 | A | * | 10/1993 | Selway | 404/25 |
| 6,036,337 | A | * | 3/2000 | Belfer | 362/287 |

FOREIGN PATENT DOCUMENTS

| | | | |
|---|---|---|---|
| FR | 2774148 | A1 | 7/1999 |
| WO | 2006/120443 | | 11/2006 |

OTHER PUBLICATIONS

PCT/EP2008/004809, International Search Report, 2 pages.

* cited by examiner

ANGLED SPRAY HEAD HOLDER

CROSS-REFERENCE TO RELATED APPLICATIONS

This application is the United States National Stage of International Application No. PCT/EP2008/004810, filed Jun. 16, 2008, which claims the benefit of Patent Applications GB 0711496.0, filed Jun. 14, 2007 and GB 0719338.6, filed Oct. 3, 2007, both of which are hereby incorporated by reference to the extent there is no inconsistency with the present disclosure.

FIELD OF THE INVENTION

The present invention relates to holders for nozzles, especially spray heads. The invention relates particularly, but not exclusively, to spray head holders for use in boats or other vehicles.

BACKGROUND TO THE INVENTION

It is desirable that shower units for boats and other vehicles be relatively compact, unobtrusive and easy to fit. A particular problem arises from a lack of space behind structures such as bulkheads into which the shower unit is to be installed. A further problem arises from the curvature of bulkheads and similar structures to which shower units and the like may have to be mounted. It would be desirable to provide a spray head holder that mitigates these problems.

SUMMARY OF THE INVENTION

Accordingly, the invention provides a holder for a spray head, the holder comprising an outer rim and a socket for receiving the spray head, the socket defining an inner mouth, wherein the inner mouth is at least partially surrounded by said outer rim, the inner mouth and outer rim being disposed in respective planes that are obliquely disposed with respect to one another, and wherein the longitudinal axis of said socket is obliquely disposed with respect to the plane in which said outer rim lies.

Preferably, an outer lip extends at least partially around said outer rim, said outer lip being obliquely disposed with respect to the plane in which said outer rim lies. More preferably, at least part of said outer lip is resilient and flexible. For example, the lip may be formed from a flexible, resilient material such as plastics.

Preferably, said outer lip provides a bevelled surface around said outer rim.

In preferred embodiments, said outer rim defines an outer mouth, said inner mouth passing through said outer mouth.

Advantageously, a wall is provided between the inner mouth and the outer rim, the arrangement being such that the wall substantially fills the space between the inner mouth and the outer rim and, preferably, provides a substantially liquid-tight barrier in the region between the inner mouth and outer rim.

Typically, an inner lip is provided around the inner mouth, the inner lip preferably being shaped to provide a substantially flat surface around at least part, and preferably all, of the inner mouth. Said flat surface preferably lies in a plane that is substantially parallel or coincident with the plane in which the inner mouth lies.

Preferably, means for locating the spray head with respect to the holder are provided substantially at said inner mouth.

Conveniently, said locating means comprises a seat extending at least partially around said inner mouth.

In preferred embodiments, the holder further includes, or is co-operable with, means for securing said holder to a support structure, said securing means comprising a body having at least one arm movable between locking and non-locking states, wherein in said locking state, said at least one arm serves to increase the dimensions of the securing means in at least one direction in comparison with the non-locking state, and wherein the securing means is mountable on a reverse face of the holder.

Preferably, a respective movable arm is provided at opposite ends of the body.

In preferred embodiments, said securing means is extends, in use, substantially transversely with respect to the longitudinal axis of the socket and, preferably, is located substantially in register with said inner mouth.

Preferably, said at least one arm is pivotable into and out of said locking state and, optionally, is resiliently biased to adopt said locking state.

Advantageously, in use at least one rotatable fixing, e.g. a screw, fixes said holder to said securing means, said at least one arm being coupled to a respective fixing such that, upon rotation of said fixing, said at least one arm is pivotable at least into, and preferably also out of, said locking state.

A second aspect of the invention provides a spray head and holder assembly comprising a spray head holder according to the first aspect of the invention, and a spray head, the spray head being shaped and dimensioned to fit into said socket.

In preferred embodiments, the spray head has a substantially linear body extending between first and second ends, and wherein said body is shaped and dimensioned to pass through said socket, said first end being engagable with said holder substantially at the mouth of the holder.

Preferably, said first end of the spray head carries a seal, the seal being received by a seat at the mouth of the holder when the spray head is fully inserted into said holder. The preferred spray head includes liquid outlets provided in the body between said first and second end, the liquid outlets being located within said holder when the spray head is fully inserted into the holder.

Typically, said second end of the spray head body is connected in use to at least one hose, the body of the holder being shaped and dimensioned to allow said at least one hose to pass through said socket.

In the preferred embodiment, the holder includes, or is cooperable with, means for securing it to a wall, for example a bulkhead. The securing means, which may for example comprise a bracket or other component fixed in use to the reverse side of the holder, optionally comprises one or more resiliently flexible or compressible projections arranged to compress or flex upon insertion of the holder through an aperture in said wall, and to return to their rest state under their own resilience having passed through said aperture.

In an alternative embodiment, the securing means comprises a body having first and second arms each being movable between a locking state and an unlocking state. The arrangement is such that, in the locking state, the arms are able to engage with the reverse face of a wall or other item in order to prevent the holder, or other item from being removed. Preferably, the arms are coupled to a screw, or similar fixing, the arrangement being such that the arms pivot or rotate in response to rotation of the screws.

A third aspect of the invention provides a spray head installation, especially a shower installation, comprising a spray head and holder assembly according to the second aspect of the invention mounted to a support structure.

A further aspect of the invention provides a holder for a spray head, the holder comprising an outer rim and a socket for receiving the spray head, the socket defining an inner mouth, wherein the inner mouth is at least partially surrounded by said outer rim, an outer lip extending at least partially around said outer rim, said outer lip being obliquely disposed with respect to the plane in which said outer rim lies.

It will be understood that the securing means described herein is not limited to use with spray head holders or housings as described herein. Accordingly, a fourth aspect of the invention provides means for securing an object to a support structure, said securing means comprising a body having at least one arm movable between locking and non-locking states, wherein in said locking state, said at least one arm serves to increase the dimensions of the securing means in at least one direction in comparison with the non-locking state, and wherein the securing means is mountable on a reverse face of the holder The spray head is preferably of the type comprising an elongate body and may be substantially bar-like or linear in shape. For example, in some embodiments, the spray head may be substantially or generally rounded or circular in transverse cross section. In preferred embodiments, the spray head includes a mixing unit for mixing hot and cold water and may also include one or more user control mechanisms.

Further advantageous aspects of the invention will become apparent to those ordinarily skilled in the art upon review of the following description of specific embodiments of various aspects of the invention and with reference to the accompanying drawings.

BRIEF DESCRIPTION OF THE DRAWINGS

Embodiments of the invention are now described by way of example and with reference to the accompanying drawings in which:

FIG. 6 is a perspective view of a spray head suitable for use with the holder of FIGS. 1 to 5; and.

DETAILED DESCRIPTION OF THE DRAWINGS

Figure 1:
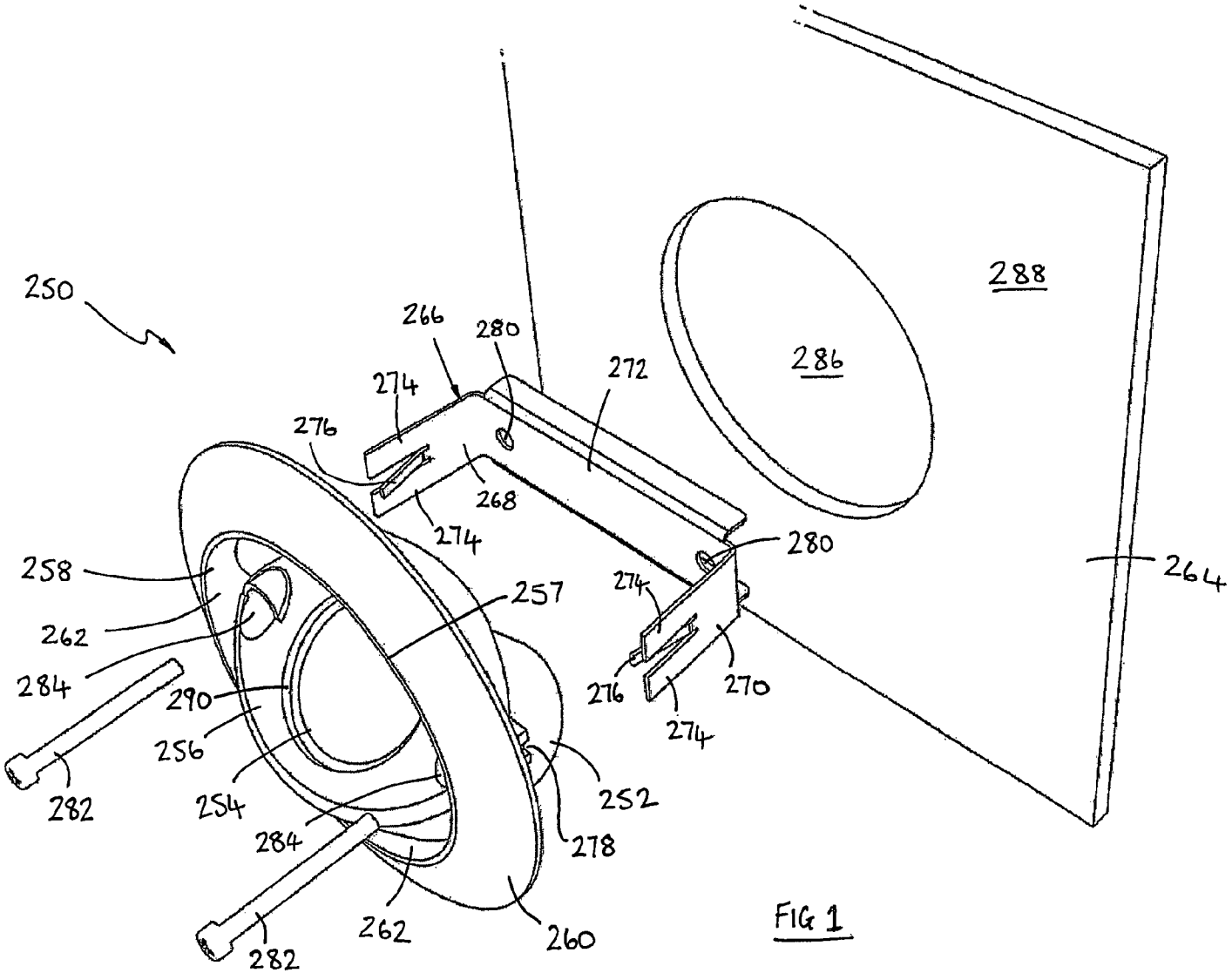
FIG. 1 is an exploded perspective view of a spray head holder embodying the invention.
Figure 2:
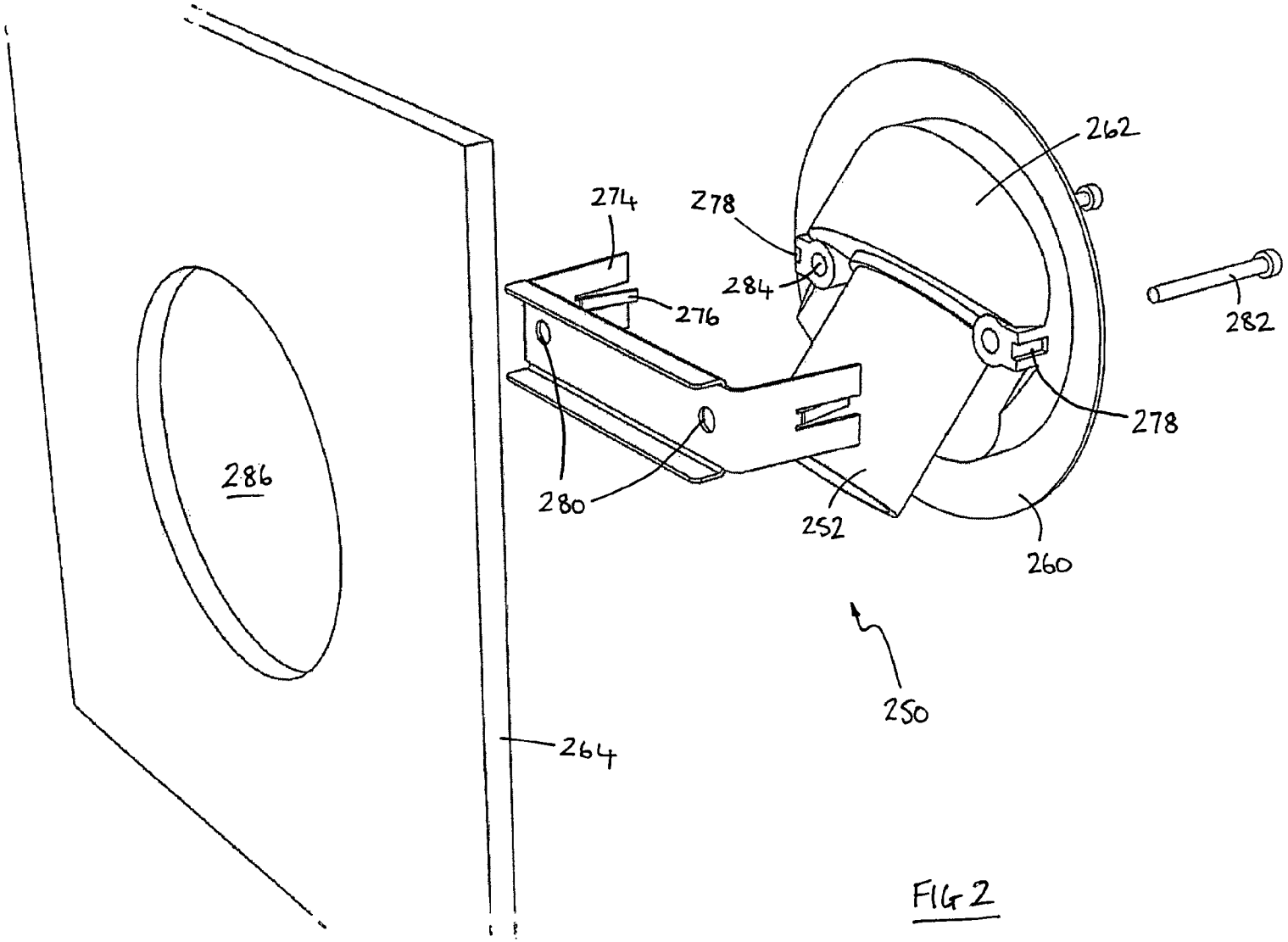
FIG. 2 is an alternative exploded perspective view of the holder of FIG. 1.

Referring now to the drawings there is shown, generally indicated as 250, a nozzle holder embodying the present invention. In preferred embodiments, the holder 250 is adapted to hold a spray head, especially the spray head for a shower. The holder 250 is particularly suited for use with nozzles comprising an elongate body, especially those being substantially linear in shape.

Figure 6:
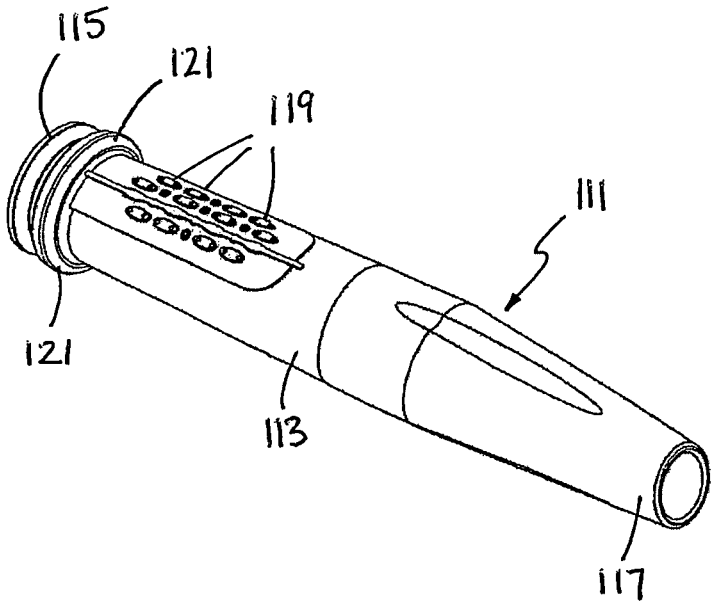
Figure 7:
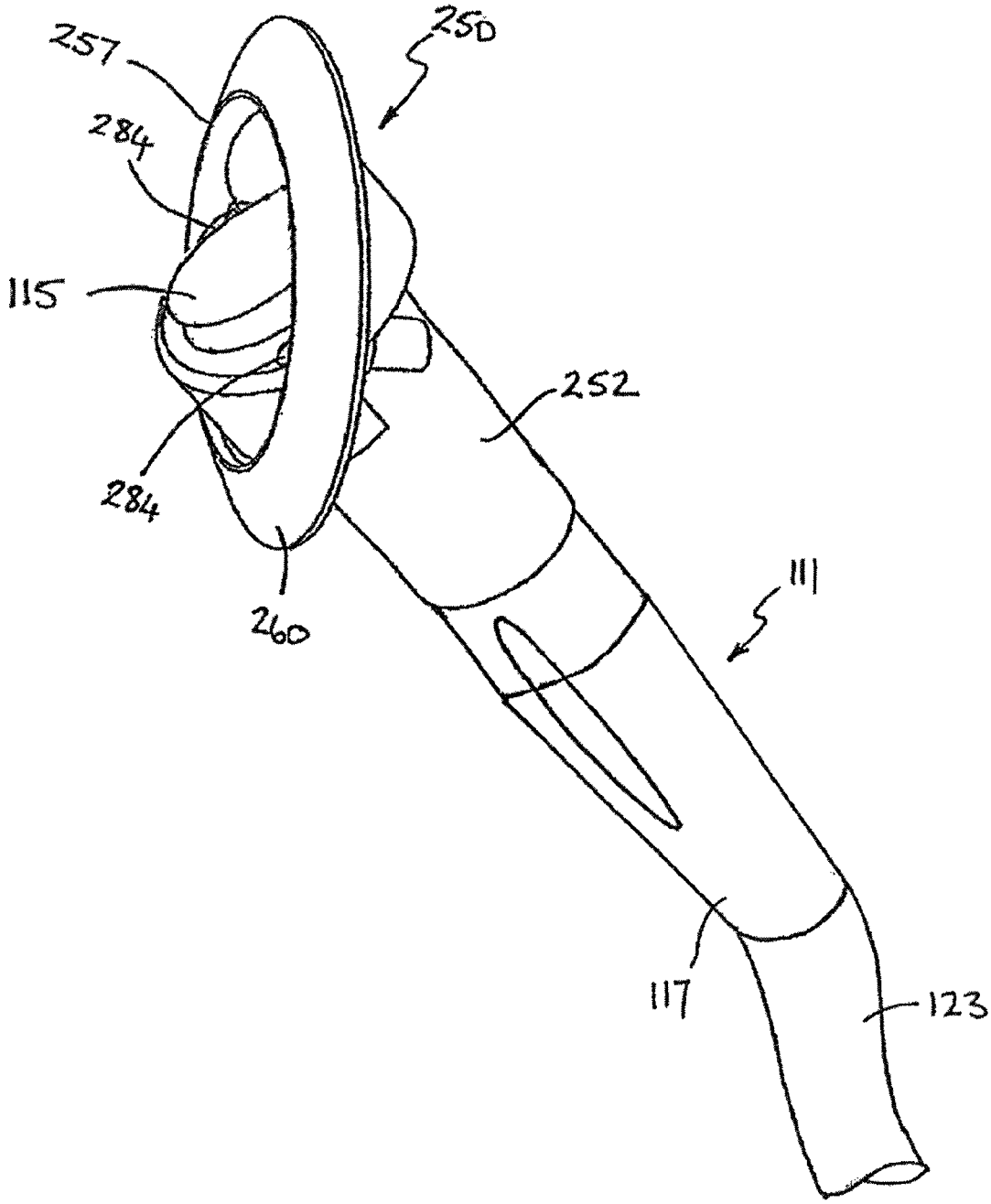
FIG. 7 is a perspective view of a spray head and holder assembly embodying another aspect of said invention.

An example of a suitable spray head is shown in FIG. 6 as 111, comprising a substantially linear, elongate body 113. In the illustrated example, the body 113 is substantially rounded or substantially circular in transverse cross-section, although it will be understood that other shapes may alternatively be used. In the illustrated embodiment, the body 113, or at least the, or each, portion of the body that is housed within the holder 10 during use, is of substantially constant cross sectional width, and may for example be substantially cylindrical in shape.

The spray head 111 has a free end 115, the opposite end 117 being connectable to a hose 123 or other means for delivering liquid, typically water, to the spray head. Preferably, the body 113 extends substantially linearly between the ends 115, 117. The spray head 111 also includes liquid outlets 119 which are preferably provided in the body 113 between its ends 115, 117. The preferred arrangement is such that the outlets 119 deliver liquid from the head 111 in a direction substantially perpendicular with the longitudinal axis of the body 113. In preferred embodiments, the spray head 111 has a sealing ring 121 located around the body 113 substantially at its free end 115, i.e. the end distal the water supply. The ring 121 preferably protrudes radially beyond at least the surrounding portions of the body 113. The ring 121 is advantageously formed from a flexible, resilient material, e.g. rubber or plastics.

In the illustrated embodiment, the holder 250 is designed, by way of example, to receive in particular the spray head 111 but it will be understood that the holder 250 may readily be adapted to receive other spray heads or nozzles.

The holder 250 is shaped to define a socket 252 for receiving the spray head 351. The socket 252 has a first, or inner, mouth 254 which opens onto a first, or inner, lip 256. The inner lip 256 is preferably shaped to provide a substantially flat surface around the mouth 254. The preferred socket 252 is tube-like in shape and, by way of example, has a substantially cylindrical body shaped and dimensioned to receive the spray head 351.

The holder 250 has an outer rim 257 defining a second, or outer, mouth 258. A second, or outer, lip 260 is provided at least partially, and preferably wholly, around the rim 257 and mouth 258. The inner mouth 254 is preferably located substantially within the outer mouth 258 and, typically, is narrower than the outer mouth 258. In the preferred embodiment, the combined width of the inner mouth 254 and the inner lip 256 is substantially equal to the width of the outer mouth 258.

The inner and outer mouths 254, 258 each lie in a respective non-parallel plane. Preferably, the inner mouth 254 lies in a plane that is obliquely disposed with respect to the plane in which the outer mouth 258 (and rim 257) lies. The inner lip preferably lies in substantially the same plane as the inner mouth 254, or in a plane that is substantially parallel therewith. Alternatively, the inner lip 256 may be bevelled with respect to the inner mouth 254. The socket 252 is advantageously arranged such that its longitudinal axis is also obliquely disposed with respect to the plane in which the outer mouth 258 lies. Conveniently, the socket 252 extends from the inner mouth 254 in a rearward direction such that its longitudinal axis is substantially perpendicular with the plane in which the inner mouth 254 lies.

The inner mouth 254 is substantially located within the outer mouth 258 or rim 257. In particular, the outer mouth 258/rim wholly or partially surrounds the inner mouth in a direction perpendicular with the plane in which the rim 257 lies. In preferred embodiments, the inner mouth 254 passes through the outer mouth 258. For example, the respective centres of the mouths 254, 258 may be substantially coincident. Alternatively, the inner mouth may be wholly or partially surrounded by the outer mouth/rim in said perpendicular direction, but otherwise located outside of the outer mouth, with the socket passing through the outer mouth. In such cases, the outer rim does not necessarily define an outer mouth, although the inner mouth is still obliquely disposed with respect to the plane in which the outer rim lies.

A wall 262 is preferably provided between the inner lip 256 and the outer mouth 258/rim 257, the preferred arrangement being such that the wall 262 and the inner lip 256 together substantially fill the space between the outer and inner mouth 254 and the outer mouth 258/rim 257. More preferably, the arrangement is such that the wall 262 and lip 256 provide a substantially liquid-tight barrier in the region between the inner mouth 254 and outer mouth 258/rim 257.

The outer lip 260 is obliquely disposed with respect to the plane in which the outer mouth 258 lies and extends rearwardly of the outer mouth 258 or rim 257. The outer lip 260, or at least part of it, is flexible and resilient. The outer lip preferably comprises a flange, bevelled with respect to the plane of the outer mouth 258 or rim 257. It is preferred that the outer lip 260, or flange, is annular, i.e. surrounds or substantially surrounds the outer mouth, although this need not necessarily be the case. By way of example, the outer lip 260, or at least part of it, may be formed from plastics, or any other suitable flexible, resilient material. The remainder of the housing 250 may be formed from any suitable material, typically plastics, and is most conveniently co-formed with the lip 260 by any suitable conventional moulding process. The outer lip may be used with holders other than those described herein.

In the preferred embodiment, the holder 250 includes, or is cooperable with, means for securing it to a support structure 264, for example a wall or bulkhead. In the drawings, the wall 264 is only shown in part for convenience. The preferred securing means comprises a bracket 266 having first and second arms 268, 270 joined by a crosspiece 272. The bracket 266 may conveniently be substantially U-shaped. Each arm 268, 270 has at least one flexible resilient finger 274, or other resiliently biased retaining component.

Each arm 268, 270 preferably also has a respective locating member which, conveniently, takes the form of a further finger 276. The fingers 276 are adapted to engage with the reverse side of the holder 250 and, to this end, the reverse side of the housing is provided with a respective groove 278 for receiving the respective finger 276.

The bracket 266 also includes a respective aperture 280 for receiving a respective screw 282 or other fixing device. In the illustrated embodiment, there are two screws 282 and two apertures 280 although more generally at least one screw/fixing and corresponding aperture or other receiving element may be provided. A respective aperture 284 is provided in the housing, e.g. in the inner lip 256 as shown, for each screw 282 or other fixing.

In use, the fingers 276 engage with the respective groove 278 to hold the bracket 266 to the holder 250. In the preferred embodiment, the fingers 276 are resiliently biased to adopt the position shown in the drawings and are pushed outwardly against their bias when engaged with the grooves 278. This causes the fingers 276 to exert a gripping force on the holder 250 to retain the bracket 266 thereon.

The assembly of the holder 250 and bracket 266 may then be inserted through an aperture 286 formed in the wall 264. The arrangement is such that the retaining fingers 274 are deflected against their bias as they pass through the wall 264 and, as the fingers 274 pass beyond the wall 264, they revert to their rest state under their resilient bias. The retaining fingers 274, when in their rest state, thus prevent the holder 250 from being removed from the wall 264 since they extend beyond the width of the aperture 286. Moreover, when the screws 282 are inserted through respective apertures 280, 284 and held in place by means of a respective nut (not shown) or other retaining element, tightening the screws 282 draws the fingers 274 into engagement with the reverse surface of the wall 264 thereby securing the holder 250 with respect to the wall 264. Hence, the holder 250 and bracket 266 are self-retaining on the wall 264—the only modification required to be made to the wall 264 or surround structure is to provide the aperture 286.

When the holder 250 is fitted to the wall 254, the outer lip 260 engages with the obverse surface 288 of the wall 264. When a retaining force is present, e.g. the force provided by the bracket 266 and screws 282 when tightened, the outer lip 260 flexes resiliently as it is pressed against the surface 288. This provides a seal between the surface 288 and the lip 260. If desired, a sealing element (not shown), for example a flexible, e.g. rubber, ring or washer, may be provided around the reverse surface of the outer lip 260 to improve the seal. The action of the outer lip 260 as described above is particularly advantageous in situations where the surface 288 of the wall 264 is not flat, e.g. curved, since the flexible nature of the lip 260 allows it to conform to the shape of the surface 288 and its resilience acts to promote a substantially sealing engagement with the surface. By way of example, the holder 250 is particularly suited for use in the transom area of a boat, which often includes bulkheads or other walls that are curved.

It will be apparent that, when fitted to the wall 264, the outer mouth 258 and rim 257 are substantially parallel with the wall 264 and the socket 252 extends obliquely with respect to the wall 264. This makes the holder 250 particularly suited to applications where there is restricted space behind the wall 264.

A seat 290 for the sealing ring 121 may be provided around the inner mouth 254. When the spray head 111 is inserted fully into the holder 250, the ring 121 is seated in the seat 290 so that substantially only the free end 115 of the spray head protrudes from the mouth 254. The ring 121 provides a sealing function to prevent or reduce the ingress of liquid or dirt past into the socket 252. The ring 121 also provides a protective function to the spray head 111, e.g. in the event that it is dropped. Alternatively, or in addition, a sealing layer or ring (not shown), which may be similar to the ring 121, may be provided around the inner mouth 254 in any convenient manner. The seat 290 need not necessarily seat the ring 121—it may alternatively be adapted as necessary to seat any other suitable part of the spray head thereby determining the extent to which the head can be inserted into the holder 250. The seat 290 thus provides means for locating the spray head with respect to the holder 250. It is preferred that the seat 290 engages with a part that is substantially at the free end 115 of the spray head so that substantially the entire body of the spray head is out of sight. It is also preferred that the engagement between the seat 290 and the head extends around substantially the whole inner mouth 254.

Figure 3:
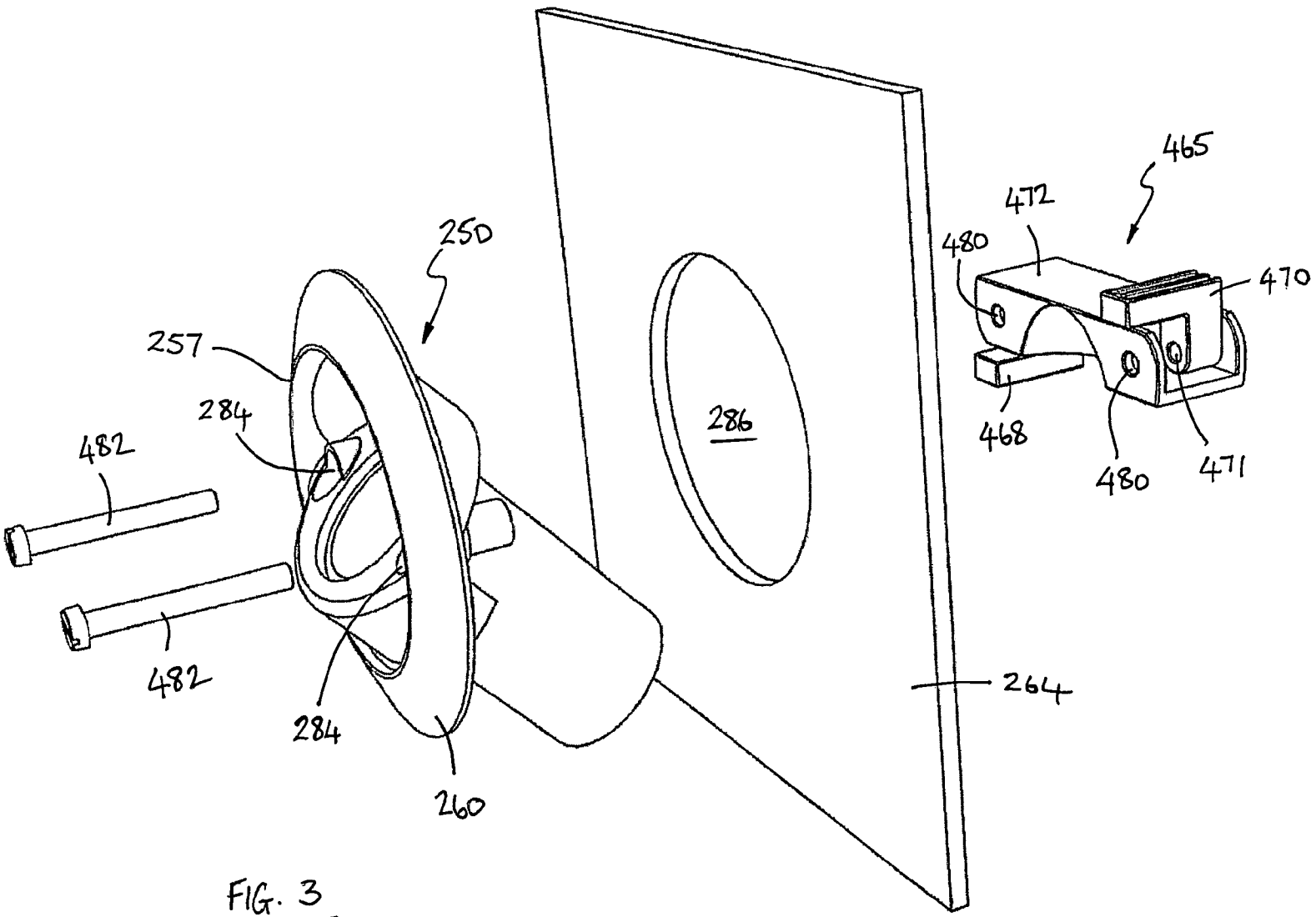
FIG. 3 is an exploded perspective view of the holder of FIG. 1 and an alternative embodiment of means for securing the holder to a support structure.
Figure 4:
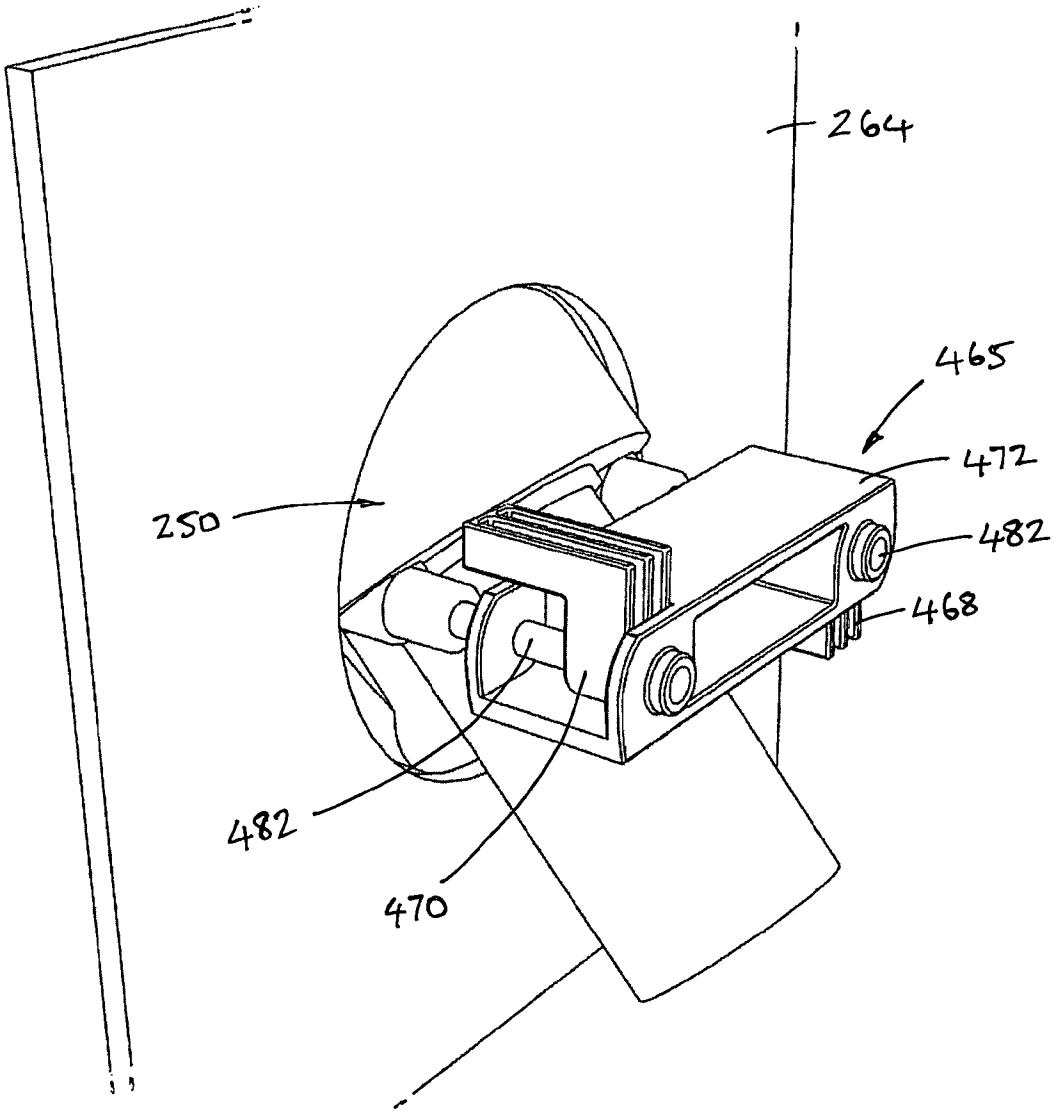
FIG. 4 is a rear perspective view of the holder and securing means of FIG. 3 in a first configuration.
Figure 5:
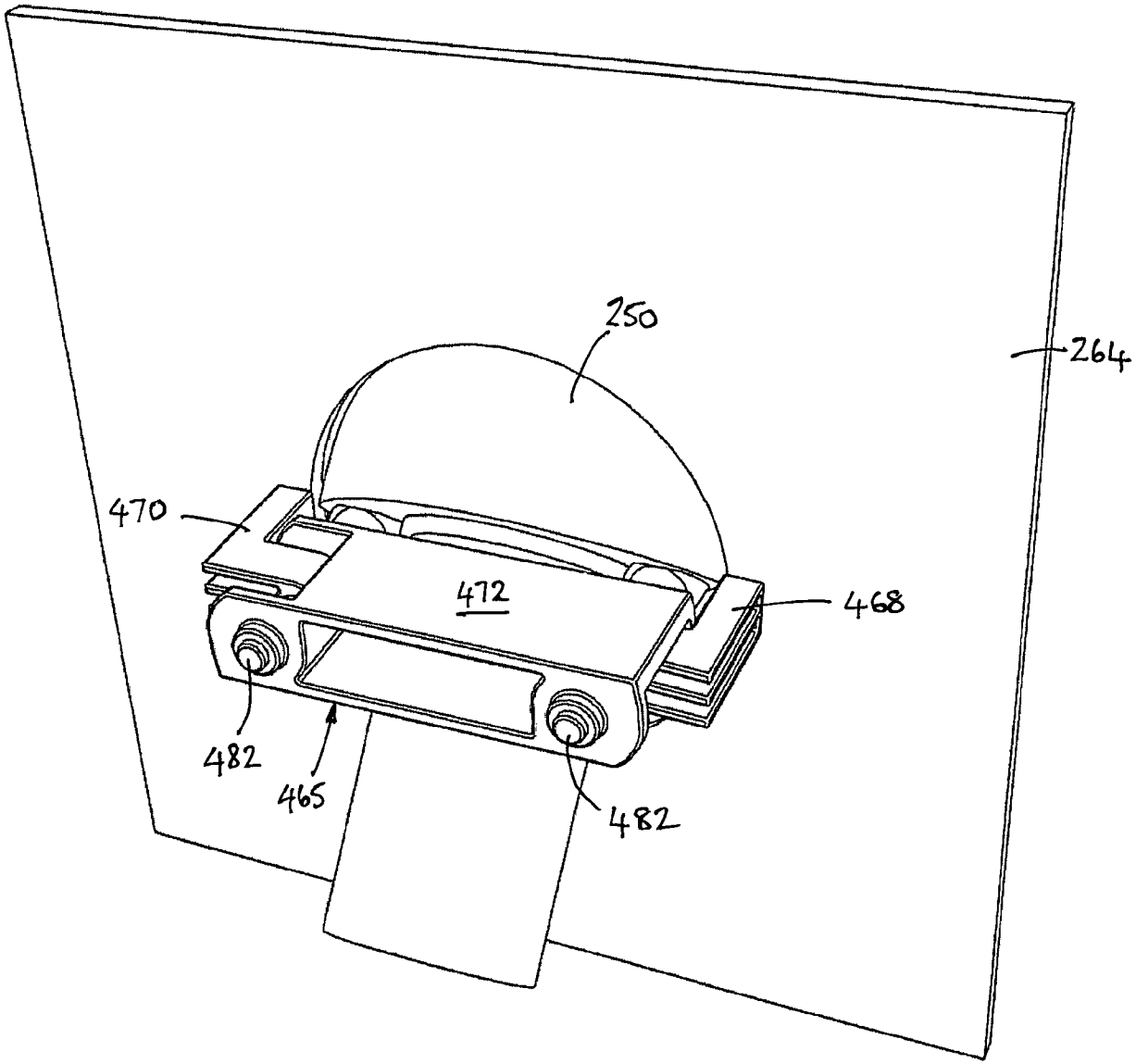
FIG. 5 is a rear perspective view of the holder and securing means of FIG. 3 in a second configuration.

Turning now to FIGS. 3 to 5, there is shown an alternative means for securing the spray head holder 250, or other compatible object, to a wall, bulkhead, or other support structure 264. The securing means, which is generally indicated as 465, comprises first and second arms 468, 470 joined by a body or cross piece 472. The arms 468, 470 are connectable to the cross piece 472 by means of a respective fixing device, preferably a threaded fixing device such as a screw 482.

The arms 468, 470 are pivotable with respect to the cross piece 472 between a respective first, or non-locking, state (as shown in FIGS. 3 and 4) and a respective second, or locking, state (as shown in FIG. 5). In the preferred embodiment, the arms 468, 470 move between the non-locking and locking states by means of a rotating or pivoting action, although in alternative embodiments the arms could move in alternative ways, e.g. sliding, depending on the configuration of the securing device 465.

The securing device 465 is dimensioned to be insertable through the aperture 286 formed in the wall 264 when the arms 468, 470 are in the non-locking state. However, when the arms 468, 470 are in the locking state, they increase the length of the device 465 in at least one direction (in the transverse or horizontal direction as shown in the drawings), such that the device 465 is no longer able to pass through the aperture 286, at least not without changing the orientation of the device 465 as a whole. In the illustrated embodiment, the arms 468, 470, when in the locking state, increase the length of the device 465 in the horizontal (as viewed in the drawings) direction such that, the arms 468, 470 are engagable with the reverse surface of the wall 264 (as shown in FIG. 5) thereby preventing the attached spray holder 250 from being removed from its seat in the aperture 286.

In the preferred embodiment, the arms 468, 470 are connected to the cross piece 472 by means of screws 482, but they may alternatively be coupled to the screws 482, or other fixing device, in any suitable alternative manner. The screws 482, or other fixings, are, in use, tightened by rotation about their longitudinal axis and the coupling between the arms 468, 470 and the screws 482, is such that rotation of the screws 482 causes a corresponding rotation of the arms 468, 470. Hence, the arms 468, 470 are movable between their unlocking and locking states by the action of tightening the screws 482. In particular, the preferred arrangement is such that the arms 468, 470 are movable from the non-locking state to the locking state upon tightening of the screws.

In the preferred embodiment, each arm 468, 470 includes an aperture 471, in particular a threaded aperture, for receiving a respective screw 482. In order to ensure that the arms 468, 470 rotate whenever the screws 482 are turned, it is preferred that a portion of the walls of the aperture 471 in the arms 470, 468 are not threaded so that, when the screw 468 is turned, its thread digs into the unthreaded surface of the aperture 471 thereby providing the respective screw 482 with purchase on the respective arm 468, 470. In practice, the unthreaded portion of the aperture 471 is conveniently at the rear of the aperture 471, i.e. opposite the end of the aperture at which the respective screws 482 enter. This allows the respective screw 482 to be partially inserted into the aperture 471, 469 prior to installation as is now described in more detail.

In order to fit the holder 250 (or other item) to the wall 264, the securing device 465 is first fitted to the holder 250 by means of the screws 482 which pass through the apertures 284 provided in the holder 250, corresponding apertures 480 provided in the cross piece 472 and the corresponding apertures 471 provided in the arms 470, 468. The assembly of the holder 250 and the securing device 465 can then be inserted through the aperture 268 as shown in FIG. 4. Subsequently, the screws 482 are tightened, i.e. rotated. This has the effect of driving the screws 482 further into the apertures 471, 469 which causes the legs 468, 470 to pivot into their locking states. Further tightening the screws 482 causes the securing device 465 to be drawn against the reverse face of the wall 264. As before this creates a clamping action whereby the flange 260 of the holder 250 is urged against the obverse face of the wall 264 and the securing device 465, and in particular the legs 468, 470, are urged against the reverse face of the wall 264. Preferably, the arrangement is such that, when the screws 482 are un-tightened, i.e. rotated in the opposite sense, the legs 468, 470 return to their non-locking states and the holder/securing device assembly can be removed from the aperture 268.

The invention is not limited to the embodiments described herein and may be modified or varied without departing from the scope of the invention.

The invention claimed is:

1. A spray head and holder assembly comprising: a spray head holder comprising an outer rim and a socket for removably receiving the spray head, the socket comprising a first open end defining an inner mouth and a second open end opposite said first open end, wherein the inner mouth is at least partially surrounded by said outer rim, the inner mouth and outer rim being disposed in respective planes that are obliquely disposed with respect to one another, and wherein the longitudinal axis of said socket is obliquely disposed with respect to the plane in which said outer rim lies; and a removable spray head, the spray head having a first free end, a second end connected to at least one hose, and a substantially linear body extending between said first and second ends, said substantially linear body being shaped and dimensioned to fit into said socket, and wherein when said spray head is received in said socket said substantially linear body is located within said socket, the longitudinal axis of said substantially linear body being substantially parallel with said longitudinal axis of said socket and correspondingly obliquely disposed with respect to the plane in which said outer rim lies, and wherein said second end of the spray head body is connected to at least one hose, the socket being shaped and dimensioned to allow said at least one hose to pass through said socket by said first and second open ends, and wherein removal of said spray head from said socket causes said hose and said substantially linear body to pass through said socket, and wherein said spray head includes liquid outlets provided in said substantially linear body, the liquid outlets being located within said socket when the spray head is fully inserted into the holder.

2. The spray head and holder assembly as claimed in claim 1, wherein said holder has an outer lip that extends at least partially around said outer rim, said outer lip comprising a flexible and resilient flange that extends at least partially around said outer rim and is obliquely disposed with respect to the plane in which said outer rim lies and which extends towards said second end of said socket to provide a bevelled surface around said outer rim.

3. The spray head and holder assembly as claimed in claim 1, wherein said outer rim defines an outer mouth, said inner mouth passing through said outer mouth.

4. The spray head and holder assembly as claimed in claim 1, wherein a wall is provided between the inner mouth and the outer rim, the arrangement being such that the wall substantially fills the space between the inner mouth and the outer rim.

5. The spray head and holder assembly as claimed in claim 1, wherein an inner lip is provided around the inner mouth, the inner lip being shaped to provide a substantially flat surface around at least part of the inner mouth.

6. The spray head and holder assembly as claimed in claim 1, wherein locating means configured to locate the spray head with respect to the holder are provided substantially at said inner mouth.

7. The spray head and holder assembly as claimed in claim 6, wherein said locating means comprises a seat extending at least partially around said inner mouth.

8. The spray head and holder assembly as claimed in claim 1, further including securing means configured to secure said holder to a support structure, said securing means comprising a body and at least one arm movable between locking and non-locking states with respect to said securing means body, wherein in said locking state, said at least one arm increases the dimensions of the securing means in at least one direction in comparison with the non-locking state, and wherein the securing means is mountable on a reverse face of the holder.

9. The spray head and holder assembly as claimed in claim 8, wherein a respective movable arm is provided at opposite ends of the securing means body.

10. The spray head and holder assembly as claimed in claim 8, wherein said at least one direction in which the dimensions of said securing means is increase in said locking state is perpendicular to the longitudinal axis of the socket.

11. The spray head and holder assembly as claimed in claim 8, wherein said at least one arm is pivotable with respect of said securing means body into and out of said locking state and is resiliently biased to adopt said locking state.

12. The spray head and holder assembly as claimed in claim 8, wherein in use at least one rotatable fixing fixes said holder to said securing means, said at least one arm being coupled to a respective fixing such that, upon rotation of said fixing, said at least one arm is pivotable into and out of said locking state.

13. The assembly as claimed in claim 4, wherein said wall provides a substantially liquid-tight barrier in the region between the inner mouth and outer rim.

14. The assembly as claimed in claim 1, wherein said second end of said substantially linear body projects through said second open end of said socket when said spray head is received in said socket.

15. The assembly as claimed in claim 1, wherein said first end of said spray head is seated in and closes said inner mouth when said spray head is received in said socket.

16. The assembly as claimed in claim 15, wherein said first end of the spray head carries a seal, the seal being received by a seat at said inner mouth of the holder when the spray head is fully inserted into said holder.

17. A spray head and holder assembly comprising: a spray head holder comprising an outer rim and a socket for removably receiving the spray head, the socket comprising a first open end defining an inner mouth and a second open end opposite said first open end, wherein the inner mouth is at least partially surrounded by said outer rim, the inner mouth and outer rim being disposed in respective planes that are obliquely disposed with respect to one another, and wherein the longitudinal axis of said socket is obliquely disposed with respect to the plane in which said outer rim lies; and a removable spray head, the spray head having first and second ends and a substantially linear body extending between first and second ends, said substantially linear body including liquid outlets and being shaped and dimensioned to fit into said socket, and wherein when said spray head is received in said socket said substantially linear body and said liquid outlets are located within said socket and said first end of said spray head is seated in and closes said inner mouth, the longitudinal axis of said substantially linear body being substantially parallel with said longitudinal axis of said socket and correspondingly obliquely disposed with respect to the plane in which said outer rim lies, and wherein said second end of the spray head body is connected to at least one hose, the socket being shaped and dimensioned to allow said at least one hose to pass through said socket by said first and second open ends, and wherein removal of said spray head from said socket causes said hose and said substantially linear body to pass through said socket.

* * * * *